United States Patent [19]

Elder

[11] Patent Number: 4,813,366

[45] Date of Patent: Mar. 21, 1989

[54] METHODS AND APPARATUS FOR PROVIDING AN IMPROVED SAILBOAT AND HULL STRUCTURE THEREFOR

[76] Inventor: Quintin J. Elder, 1215 W. Camelot Dr., Provo, Utah 84601

[21] Appl. No.: 658

[22] Filed: Jan. 6, 1987

[51] Int. Cl.[4] ..... B63B 1/20

[52] U.S. Cl. ..... 114/61; 114/256; 114/283; 114/363

[58] Field of Search ..... 114/34.1, 61, 123, 283, 114/292, 357, 270, 56, 57, 256, 291, 363

[56] References Cited

U.S. PATENT DOCUMENTS

| | | | |
|---|---|---|---|
| 3,090,339 | 5/1963 | Carr | 114/292 |
| 3,547,062 | 12/1970 | Rainu | 114/292 |
| 3,796,175 | 3/1974 | Ford et al. | 114/39 |
| 4,193,370 | 3/1980 | Schoell | 114/56 |
| 4,224,889 | 9/1980 | Spiegel | 114/39 |
| 4,295,236 | 10/1981 | Upchurch | 114/61 |
| 4,311,108 | 1/1982 | Horton | 114/61 |
| 4,378,747 | 4/1983 | Beatty et al. | 114/56 |
| 4,445,453 | 5/1984 | Morgan | 114/56 |
| 4,498,409 | 2/1985 | Edel | 114/283 |
| 4,601,667 | 7/1986 | Hull | 441/131 |

FOREIGN PATENT DOCUMENTS

| | | | |
|---|---|---|---|
| 974821 | 9/1975 | Canada | 441/79 |

OTHER PUBLICATIONS

Alexander, "The NACRA 5.8," Multihulls, (Sep./Oct. 1982).

Alexander, "Multihulls on Boat Tests," Multihulls, p. 70, (Jul./Aug. 1983).

Alexander, "Fast Cats!, " Yacht Racing and Cruishing, p. 66, (Jul./Aug. 1984).

Hobie Cat 14.

Hobie Cat 16.

Hobie Hotline, (Nov./Dec. 1984).

NACRA.

"The Catamarans with NACRA Tradition."

Nomad 14.

Prindle Catamarans.

Sunfish, Minifish, Puffer, Force 5.

Trac 14, Trac 16, and Trac 18.

Trac 18 Competition Comparison.

*Primary Examiner*—Sherman D. Basinger

*Assistant Examiner*—Stephen P. Avila

*Attorney, Agent, or Firm*—Workman, Nydegger & Jensen

[57] ABSTRACT

A catamaran and related hull configuration. The hull of the current invention has two generally curved indentations which run most of the length of the hull. Running down the center of the underside of the hull, and separating the two indentations, is a slightly elongated keel section. While the hull is moving through the water the indentations act as hydrofoils, lifting the hull out of the water and reducing the water resistance. At the same time the elongated keel provides stability. The hull may be incorporated into a catamaran which easily collapses for storage and transportation, or for use as a fishing boat.

27 Claims, 3 Drawing Sheets

METHODS AND APPARATUS FOR PROVIDING AN IMPROVED SAILBOAT AND HULL STRUCTURE THEREFOR

BACKGROUND

1. The Field of the Invention

The present invention is related to a novel sailboat and hull configuration which is particularly adaptable for use in sailboats such as catamarans. More particularly, the present invention is related to a catamaran which is collapsible and easily transportable together with a hull which includes twin hydrofoil structures.

2. Background of the Invention

While sailboating is, of course, an ancient activity dating back to approximately the beginning of recorded history, it has recently enjoyed a surge in popularity as a sport or leisure time activity. Sailboats of all descriptions are now in used in recreation. These include sailing yachts of 50 feet in length of more, as well as dinghys which may be well under 10 feet in length. One of the factors contributing to the popularity of sailboating as a sport is the wide variety of boats available. There are boats available to match virtually every type of taste.

Many types of basic sailboats are now on the market. One type of basic monohull recreational sailboat, which can be used for purposes of illustration, is approximately 14 feet long. This boat has generally vertical planar sides approximately 1½ to 2 feet in height with a generally V-shaped hull. It has a 6 foot 2 inch beam, weighs about 265 pounds and is usually transported using a small trailer. This particular boat is equipped with a 75 square foot main sail and a 35 square foot jib. Thus, the total sail area is 110 square feet, which is typical in boats of this type. The boat employs a conventional daggerboard for stability and also to avoid slippage in the water as the wind catches the sail. The boat is also equipped with a conventional rudder mounted to the rear of the boat to facilitate steering and maneuvering the boat.

Many variations of such a basic recreational sailboat are currently on the market. Typically, however, basic boats of this type, which are approximately 14 feet in length, weigh between 250 and 350 pounds and have between 90 and 115 square feet of sail. These boats are easy to sail, but are not particularly fast. In addition, they are generally transported and stored using a conventional boat trailer.

In the late 1960's there was a desire by recreational sailboaters to develop a boat which would be more challenging and exciting to sail than the basic recreational sailboat described above. One concept was to take the general catamaran, or multiple hull, design which had been used on larger boats and employ it in smaller recreational boats. It was anticipated that the use of the multi-hull catamaran design would lead to a faster boat which was more exciting to sail.

One of the first makers of small recreational catamarans was Hobie Cat Corporation of Oceanside, California (now a subsidiary of Coleman Co.). That company began manufacturing small catamarans in 1968. This type of boat has received wide acceptance within the recreational boat market.

An analysis of the specifications of some small catamarans provides an understanding of their popularity and wide acceptance. While small catamarans may be 19 feet long and longer, for purposes of comparison with the basic boat described above, 14 foot catamarans are emphasized.

While the basic 14 foot sailboat weighs between 250 and 350 pounds, a 14 foot catamaran is typically about 50 pounds lighter weighing from about 195 to 300 pounds fully rigged. At the same time, recreational catamarans generally employ a much larger total sail area. While the basic boats described above have about 90 to 115 square feet of sail, a 14 foot catamaran generally has 120 to 150 square feet of sail, with several of the most popular 14 foot catamarans having sail areas in excess of 145 square feet. When comparing sail area to weight it can be seen that a typical basic boat may have a sail area to weight ratio of about 0.4 square feet/pound, while a typical catamaran of the same length may be expected to have a ratio approaching 0.8 square feet/pound. Thus, it can be appreciated that small recreational catamarans are generally must faster than their conventional counterparts, having about twice as much sail area per pound of boat.

An additional factor in the performance of sailboats is, of course, the hull configuration. Conventional sailboats have hulls which contact the water over an area approximately equal to the surface area of the boat (i.e. the average beam width times the length). Catamarans, conversely, have two or more hulls which contact the water over a relatively small area equal to only a small fraction of the surface area of the boat. FIG. 1 illustrates a typical recreational catamaran configuration 10. The two hull members 12 support the entire weight of the boat. Thus, while at rest the water line may be expected to be at a point approximately one-third to one-half of the distance up the hull, resulting in a small area of contact between the hull and the water. This reduced area of hull-water contact reduces the boat's resistance as it moves through the water, greatly increasing its potential speed of travel. This is particularly true when it is appreciated that in moderate to heavy winds, one of the boat's hull members 12 is likely to be lifted completely out of the water.

A major problem which has developed, however, is in maintaining the boat's stability while at the same time minimizing the wetted surface of the hulls. Essentially, two general types of hull configurations have been developed in the art. These hull types are the symmetrical hull and the asymmetrical hull. Cross sections of symmetrical and asymmetrical hulls are shown in FIGS. *2a–2d.*

FIGS. *2a* and *2b* illustrate a popular configuration of an asymmetrical hull generally designated 14. When fully assembled the curved surface 16 of hull 14 would face the interior of the boat. FIG. *2a* illustrates hull 14 at rest in the water. FIG. *2b* illustrates the hull 14 as it would appear while traveling through the water at a point where the boat's other hull has lifted out of the water or is about to lift out of the water.

FIGS. *2c* and *2d,* conversely, illustrate a symmetrical hull design. The symmetrical hull is generally designated 18. FIG. *2c* shows the symmetrical hull 18 at rest, while FIG. *2d* shows the hull 18 as it would appear while traveling through the water. The characteristic common to symmetrical hulls is that the configuration of the inside surface 20 is essentially a mirror image of outside surface 22.

The major difference in operation between the symmetrical hull 14 and the asymmetrical hull 18 is the amount of wetted surface. Because of their shape, asymmetrical hulls, such as hull 14, have more wetted surface than do symmetrical hulls, such as hull 18. Thus, if this isolated factor were considered it would be expected that boats with symmetrical hulls 18 would be faster than boats with asymmetrical hulls 14.

A problem that arises in the use of symmetrical hulls, however, is that of stability. While the decreased wetted surface may make the hull faster, it also makes the hull less stable. It is often found, therefore, that in order to provide sufficient stability for a boat with symmetrical hulls, it is necessary to add daggerboards.

FIG. 3 is a side elevational view of one popular configuration of a small catamaran having symmetrical hulls. Shown in FIG. 3 are a hull 24, a rudder 26 and a daggerboard 28. It will be appreciated that the addition of a daggerboard 28 presents additional problems. One significant problem is that the operator of the boat must be careful to lift the daggerboard 28 before the boat is beached. In addition, daggerboard 28 causes additional resistance as the boat 30 travels through the water, thus losing some of the speed gained by employing symmetrical hulls.

From the discussion above, however, it is clear that prior art hull designs have included some compromises. While asymmetrical hulls are found to be slightly slower than symmetrical hulls, asymmetrical hulls are generally significantly more stable and may not require the use of daggerboards. Likewise, while symmetrical hulls are fast, they are unstable and usually require the use of daggerboards to maintain stable operations.

Another problem encountered in currently available catamarans is associated with transporting and storing the boat when not in use. Most conventional catamarans have cross bars which connect the two hulls and which provide support for the passenger area, generally comprising a "trampoline." Generally the cross bars are securely attached to the hulls of the boat so that the width of the boat remains constantly approximately 8 feet. Thus, special trailers and storage facilities are required to handle conventional catamarans.

Thus, what is needed in the art is a catamaran which is easily transported and stored. In addition, it would be an advancement in the art to provide a catamaran hull that is fast yet does no require the use of daggerboards for stability. It would be a further advancement in the art to provide a catamaran hull which has no more wetted surface than conventional symmetrical hulls. It would be a further advancement in the art if such a hull could be provided which was as stable as conventional asymmetrical hulls but was capable of operation without the use of daggerboards or other similar conventional means of stabilizing the hull. It would be another advancement in the art to provide a catamaran which is flexible in use being usable as a dinghy, a wind surfer, a fishing boat, and for other uses. Such a catamaran and catamaran hull are described and claimed below.

BRIEF SUMMARY AND OBJECTS OF THE INVENTION

The present invention is related to a new and unique catamaran and catamaran hull configuration. The boat of the current invention is particularly adaptable for use as a sport or recreational catamaran. The boat and hull configuration, however, are capable of being adapted for other types of uses.

One of the inventive features of the present invention is the configuration of the underside of the hull. In one embodiment of the current invention, the hull has two generally semi-circular indentations which run most of the length of the underside of the hull. The two sides of the hull are essentially mirror images of one another. Thus, the hull may be classified as a symmetrical hull.

Running down the center of the hull and separating the two indentations, is a slightly elongated keel section molded as part of the hull. When the hull is resting in the water, the keel will extend into the water somewhat further than will the outside edges of the hull's underside. This hull configuration is remarkably fast and is particularly adaptable for use in sport and recreational catamarans.

As a catamaran using the hulls described above begins to move through the water, the twin identations cause the hulls to lift slightly. It is found that a hydrofoil effect is created so that the boat begins to ride on a cushion of air or water mixed with air. As a catamaran picks up speed it is not unusual for the boat to tip to one side until one of the boat's hulls raises completely out of the water. At this point it is important that the boat be stable enough to prevent capsizing. Stability is particularly important in the current invention because a tilting of the boat may well cause the entire boat to ride on one-half (one hydrofoil) of one hull. It has been found, however, that the elongated keel section of the hull provides sufficient stability for safe and stable operation of the boat, even at high speeds and even while running on only one hull.

The boat hull of the current invention also solves the problems encountered in the prior art with respect to transportation and storage. The crossbars of the current invention, which run between the hulls, are easily removable, as is the trampoline. Once the crossbars are removed the two hulls may be attached to one another, if desired, for ease of transportation and storage. In addition, it may be desirable to employ a two piece mast so that the entire boat may be easily disassembled and stored or transported in a small area measuring approximately 9 feet by 3 feet. This is as opposed to the 14 feet by 8 feet area required for conventional small catamarans.

It is therefore, a primary object of the present invention to provide a small catamaran and associate hull which is easily disassembled for storage and transportation.

It is another object of the present invention to provide such a hull which is both stable and fast.

It is a related object of the present invention to provide a unique symmetrical hull configuration which creates a hydrofoil effect.

It is another object of the present invention to provide a boat hull having an integral keel section which does not require the use of conventional daggerboards and the like.

These and other objects and advantages of the current invention will become apparent upon reading the following detailed description and appended claims, and upon reference to the accompanying drawings.

DETAILED DESCRIPTION OF THE PREFERRED EMBODIMENT

The present invention can be best understood with reference to the drawings, wherein like parts are designated with like numerals throughout. The current invention relates to a novel and inventive catamaran configuration which is both stable and fast in operation and which does not require the use of daggerboards or the like and which can be easily disassembled for storage or for other types of uses.

Figure 4:
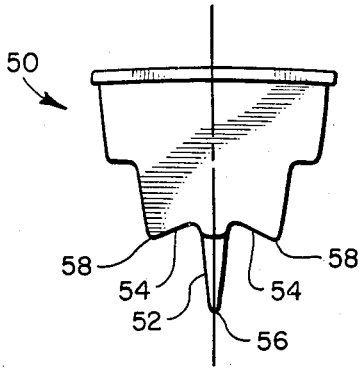
FIG. 4 is a cross-sectional view of one embodiment of the hull of the current invention.
Figure 5:
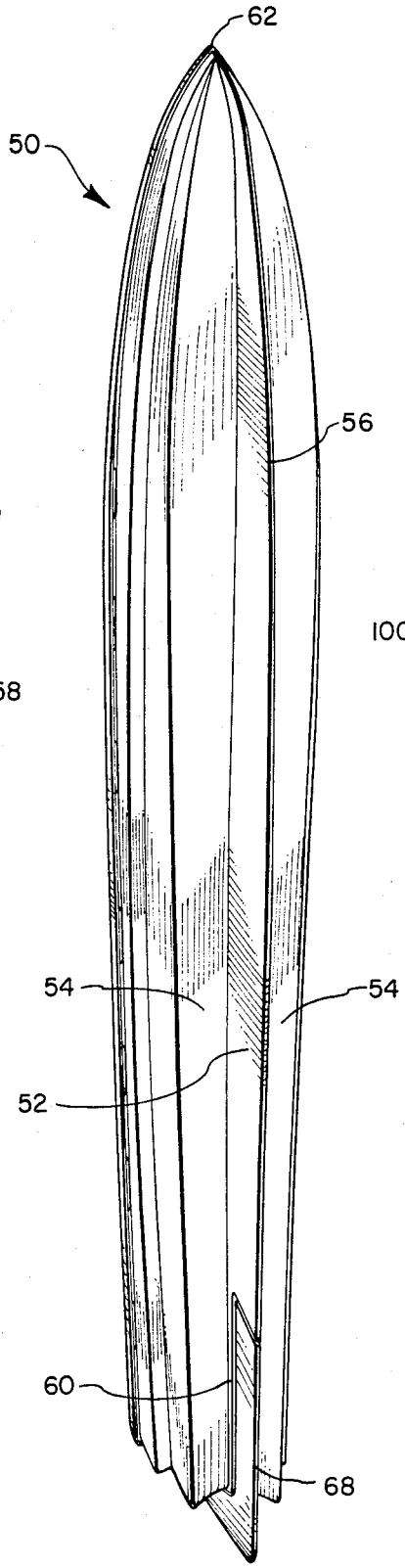
FIG. 5 is a perspective view of the underside of the hull of the current invention.

FIG. 4 illustrates a cross section of one embodiment of the hull of the current invention, generally designated 50. It will be appreciated that the upper portions of the hull 50, those portions which remain out of the water during normal operation, may be configured in any desired shape. FIG. 5 simply illustrates one such possible design. FIG. 5 also illustrates one embodiment of the underside 52 of hull 50.

Hull 50 may be constructed in any manner conventional within the boating industry. It is expected, however, that one preferred method of construction will be to provide a foam interior for the hull 50, coated with fiberglass. This will make hull 50 exceedingly light and will also assure that hull 50 will not sink. As a result, it will be possible to use hull 50 as a lifeboat and for other similar uses.

The underside 52 of hull 50 includes a series of unique structural features. Specifically, the underside 52 of hull 50 includes a pair of generally curved indentations 54. Indentations 54 may be configured in a variety of ways and with a variety of curvatures, however, the indentations 54 as illustrated in FIG. 5 have been found to be effective.

Another important structural feature of the underside 52 of hull 50 is an elongated center portion or molded keel 56. In the illustrated embodiment the keel 56 is molded as an integral part of the underside 52 of the hull 50. It will be appreciated that the keel 56 could be formed in any of a variety of ways and could in fact be capable of being inserted and removed in the form of a centerboard.

The cross section of underside 52 of the hull 50 begins at one of the outside edges 58 and follows a curved path, forming indentation 54, as it progresses toward the center. The center of the underside 52 of hull 50 is the elongated keel structure 56. Since the hull 50 is generally symmetrical, the opposite sides of the hull 50 comprises essentially mirror images.

FIG. 5 is a bottom view of the hull 50 of the current invention and shows the structural features described above with reference to FIG. 4. The embodiment of the invention shown in FIG. 5 shows the keel 56 running the vast majority of the length of the underside 52 of hull 50. Virtually the only longitudinal portion of underside 52 which does not include keel 56 is the very rear of the hull, designated 60. One reason for not continuing keel 56 to the rear 60 of the hull 50 is in order to facilitate the attachment and use of a rudder at the back of the boat. It can also be seen with reference to FIG. 5, that the symmetrical identations 54 also essentially run the length of the hull 50.

In operation, the configuration of hull 50 provides for outstanding performance when incorporated on a catamaran as described below. As the hull 50 begins to move through the water, water and water mixed with air begin to move through the identations 54. This flow of fluids under the hull 50 provides a lifting force as the boat accelerates. The effect of the two indentations 54 is to provide a dual hydrofoil effect. As the boat gains speed it tends to be lifted out of the water decreasing the wetted surface area and also assuring that the front of the boat does not drop. This is in direct contrast to the operation of conventional catamarans where the hull tends to be buried in the water as the boat accelerates.

The hydrofoil effect of indentations 54 cause several beneficial results for a boat constructed using hulls 50. First, the hydrofoil effect reduces the wetted surface, correspondingly increasing the potential speed of the boat. Since one of the highly desirable characteristics of catamarans is their speed, generally the high speed potential of the current invention represents a very significant benefit and advancement in the art.

A second benefit flowing from the hydrofoil effect is the fact that the nose 62 of the hull 50 tends to be lifted. A serious problem encountered with some catamarans, especially in rough weather conditions is the tendency for the nose to dip into the water. This not only causes the boat to lose speed, but may cause the boat to cartwheel or "pitchpole." This is clearly a very dangerous problem. Using the hull configuration of the current invention, however, avoids the problem of the nose 62 dipping into the water.

As an alternative, it may be desirable to add a conventional hydrofoil attachment to the underside of hull 50. This may provide an additional lifting effect.

The configuration of the current invention also solves the problem of stability for the catamaran hull. As discussed above, while prior art symmetrical hulls generally have less wetted surface and are often, therefore, faster than comparable boats having asymmetrical hulls, they were also unstable and may be more prone to capsizing. The hull 50 solves the problem of stability, without adding daggerboards, by providing the elongated keel 56. Keel 56 provides a substantial improvement in boat stability without adversely affecting the boat's potential speed. As can be appreciated with reference to FIG. 7, keel 56 extends into the water far enough to prevent capsizing and also prevents any potential lateral slippage through the water.

Figure 1:
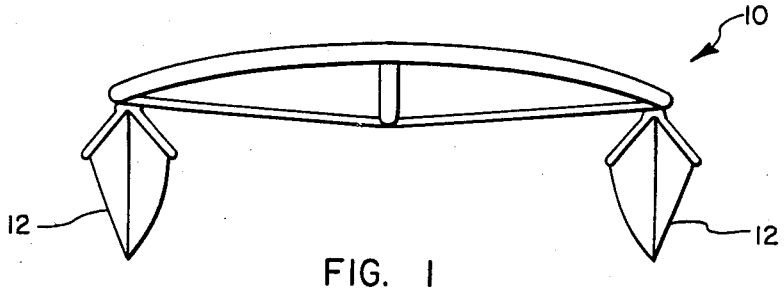
FIG. 1 (PRIOR ART)
FIG. 1 is a front elevational view of a conventional recreational catamaran without the sails and related rigging.
Figure 2A:
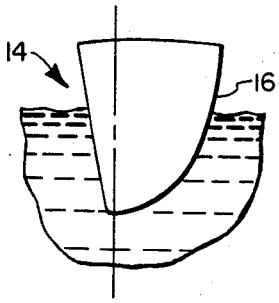
FIG. 2A (PRIOR ART)
FIG. 2*a* is a cross-sectional view of an asymmetrical catamaran hull at rest in the water.
Figure 2B:
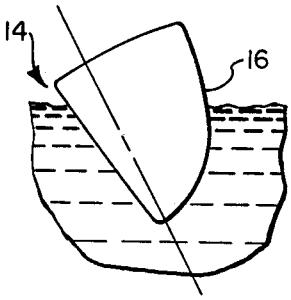
FIG. 2B (PRIOR ART)
FIG. 2*b* is a cross-sectional view of an asymmetrical catamaran hull while travelling through the water.
Figure 2C:
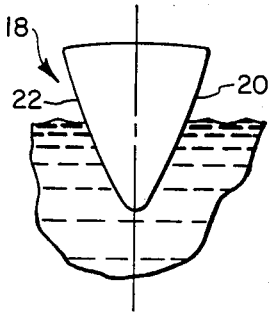
FIG. 2C (PRIOR ART)
FIG. 2*c* is a cross-sectional view of a symmetrical catamaran hull at rest in the water.
Figure 2D:
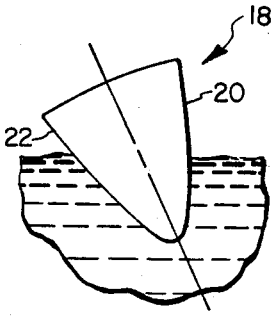
FIG. 2D (PRIOR ART)
FIG. 2*d* is a cross-sectional view of a symmetrical catamaran hull while travelling through the water.
Figure 3:
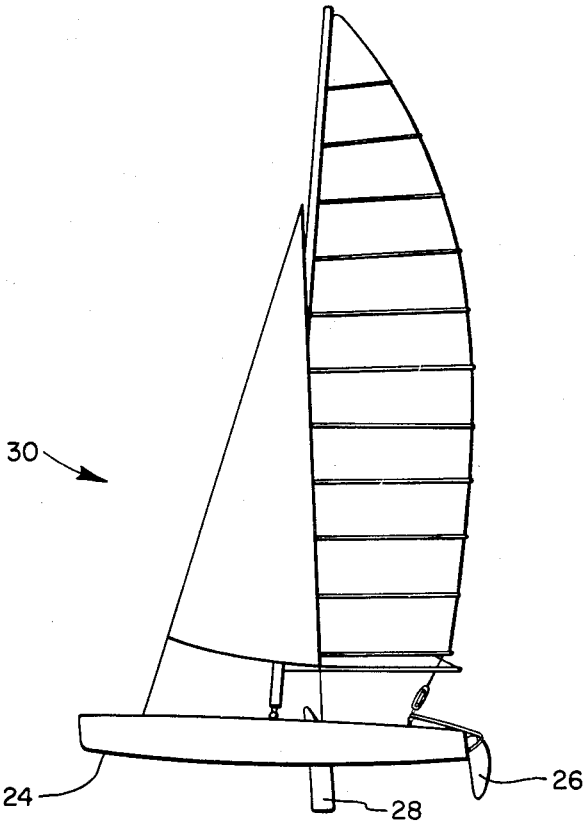
FIG. 3 (PRIOR ART)
FIG. 3 is a side elevational view of a recreational catamaran showing a daggerboard and rudder.

As can be best appreciated with reference to FIG. 5, keel 56 is molded so that it smoothly joins the nose 62 of the hull 50. Thus, the front of the boat is able to present a smooth, low friction surface as it travels through the water. This is in direct contrast to the surface presented by conventional daggerboards. As shown in FIG. 3, daggerboard 28 causes an abrupt change in the way in which the boat contacts the water. While the front part of hull 24 presents a generally smooth surface to the water, this is abruptly broken by centerboard 28. Centerboard 28 clearly causes a significant drag on the boat as a whole.

The smooth surface presented by the keel 56 of the current invention at the nose 62 of hull 50, continues through the length of the boat. No abrupt changes exist in the amount and character of hull surface which contacts the water.

As mentioned above, the keel 56 represents a substantial stabilizing force. As can be appreciated with reference to FIGS. 4 and 6, the keel 56 places a relatively large surface area of material in the water 100 so that the boat does not tend to capsize or to slip laterally. Even while the boat is moving at high speed and while one hull 50 may have been lifted out of the water 100, keel 56 continues to provide stability to the boat because it continues to extend into the water.

Figure 6:
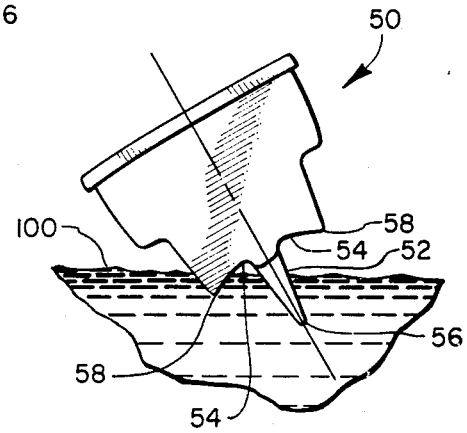
FIG. 6 is a cross-sectional view of the hull of the current invention illustrating its position while travelling through the water.

FIG. 6 illustrates the approximate position of hull 50 while it is incorporated into a catamaran and the catamaran is moving at high speed. As the boat tilts in the water 100, hull 50 will tip to one side. This may result in one of the hydrofoil producing indentations 54 being rotated partially out of the water. The boat then will be riding on the remaining portion of the underside 52 of hull 50 which essentially comprises the remaining indentations 54 and keel 56.

The boat while in this position would be unstable and likely to tip over in the absence of keel 56. Keel 56, however, while aiding in the production of the hydrofoil effect by defining one side of identation 54, also remains in the water acting as an effective daggerboard. The primary points of contact between the boat and the water 100 are, therefore, one of the outside edges 58 and the keel 56. This provides a stable hull 50 which has a minimum of wetted surface.

Figure 7:
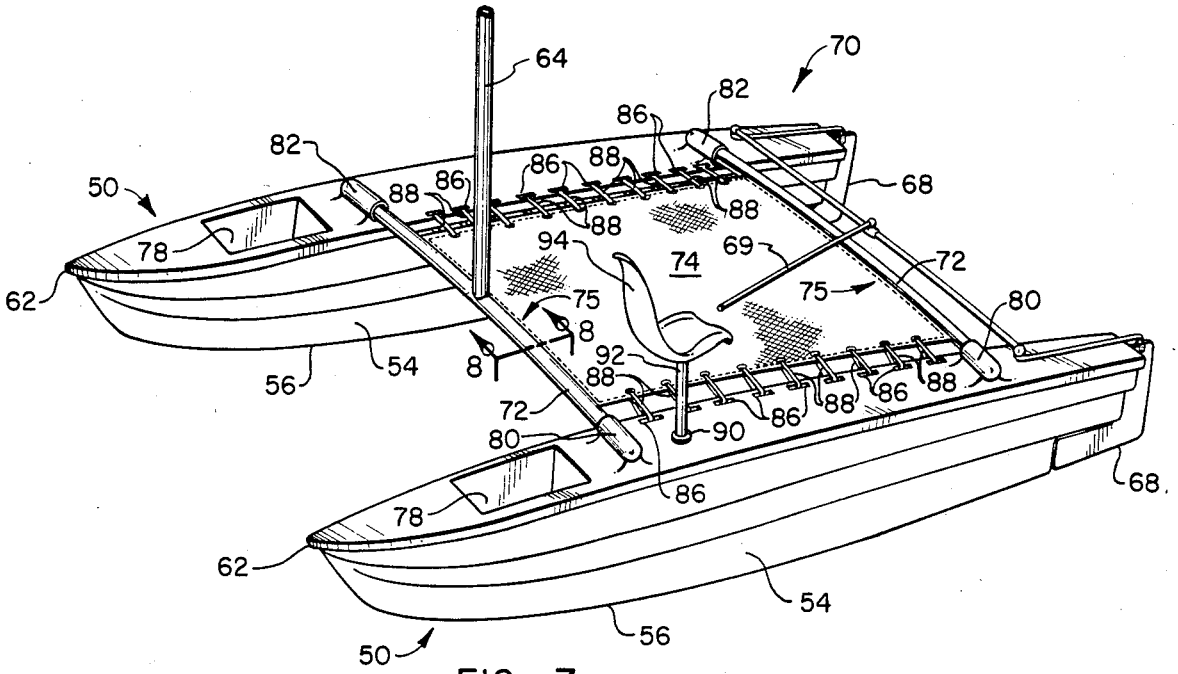
FIG. 7 is a perspective view of the assembled catamaran and hull of the current invention with the sails omitted.

As mentioned above, it is expected that the hull 50 will be particularly adaptable for use in boats such as recreational catamarans. One such boat configuration is illustrated in FIG. 7. FIG. 7 is a perspective view of such a catamaran (omitting sails) having as its base a pair of hulls 50. Extending upwardly from the level of hulls 50 is a mast 64 which is used to suspend the boat's sails. The sails may be rigged in any manner which is conventional and well known in the art.

The catamaran 70 will also be equipped with a steering mechanism. The steering mechanism illustrated is a conventional rudder 68 and handle mechanism 69. Because of the extreme stability provided by keel 56 and because of the fact that the nose 62 of the hulls 50 will lift out of the water, rudder 68 may be slightly truncated, conforming generally to the curvature of keel 56 rather than extending deeply into the water. Because hulls 50 employ no daggerboards they are particularly adaptable for being launched and docked on a beach so that a truncated rudder 68 would be compatible with the expected overall use of the boat.

Also illustrated in FIG. 7 is one preferred method of holding hulls 50 in place. That method comprises a pair of cross members 72 which are secured between the hulls 50. One method of securing cross members 72 is to first securely mount sleeves 80 and 82. Sleeves 80 and 82 are expected to be short lengths of pipe having slots running the length of sleeves 80 and 82. Since sleeves 80 and 82 are open along one side and can therefore be expanded or contracted slightly, it is a simple matter to slide cross members 72 into sleeves 80 and 82. Once cross members 72 are in place it may be desirable to secure them to sleeves 80 and 82 using a removable locking pin or bolt.

It will be appreciated that the cargo area of catamaran 70 may be constructed in a variety of ways. One commonly used cargo area is a "trampoline" structure 74. Trampoline 74 is extended across the general area defined by the hulls 50 and the cross members 72. The trampoline material is secured in place on the hulls 50 and may also be secured to cross members 72.

Figure 8:
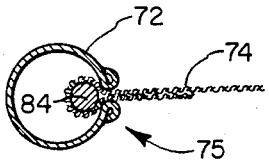
FIG. 8 is a cross-sectional view of the connection between the cross members and the trampoline.

A preferred method of attaching trampoline 74 to cross members 72 is through the use of a conventional luff rope 84 as illustrated in FIG. 8. The luff rope 84 is secured within the edges of trampoline 74. The luff rope, including the attached portion of the trampoline will be treaded within the open edge of cross member 72. This connection, generally designated 75 is shown in cross section in FIG. 8, and as it would appear in use in FIG. 7.

FIG. 7 also illustrates one method of attaching trampoline 74 to hulls 50. In one embodiment, hulls 50 will be provided with a plurality of slots 86. Straps 88 can then be feed through slots 86 and secured and tightened as desired. One method of securing straps 88 would be through the use of D-rings. It may also be possible to secure straps 88 using Velcro strips disposed on straps 88.

The features described above combine to accommodate the transportation and storage of catamaran 70 and also provide catamaran 70 with additional potential uses. In order to store or transport catamaran 70, straps 88 are simply removed from slots 86. At this point cross members 72 may be removed from sleeves 80 and 82. Since it is anticipated that mast 64 may be a two-piece mast, it may be possible to roll mast 64, the sail, trampoline 74 and cross members 72 into a relatively compact package.

Figure 9:
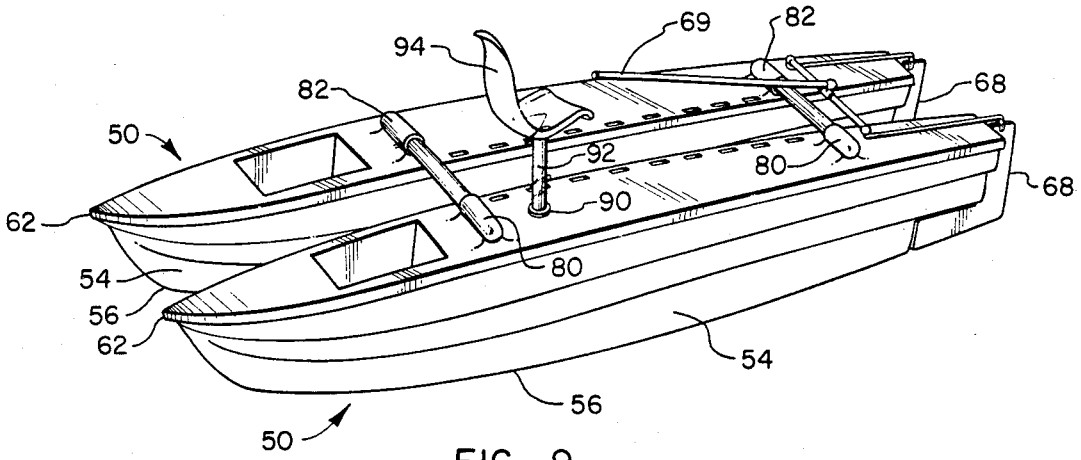
FIG. 9 is a side elevational view of the hull of the current invention attached for storage or for use as a fishing boat.

It is also anticipated that sleeves 80 will be constructed so as to be capable of fitting securely within sleeves. 82. Thus, hulls 50 may be secured together for storage or transportation as illustrated in FIG. 9.

The hull 50 may be constructed with various additional accessories and features. For example, the hull 50 illustrated in FIG. 7 contains a built-in ice chest 78. It is now common in the art to add complex attachments to the forward cross members of catamarans to provide a means for storing an ice chest. The current invention, however, provides the convenience of an ice chest without the addition of bulky and complex attachments.

In addition, it may be desirable to provide hulls 50 with openings 90 for receiving a seat post 92 and an accompanying bucket seat 94. Thus, hulls 50 may be attached by sleeves 80 and 82 as described above, and seat 94 attached to form a fishing boat.

In summary, the present invention is a unique boat configuration and hull design which is particularly adaptable for the construction of a catamaran. The hull 50 has a unique configuration which provides a twin hydrofoil effect which generally tends to lift the hull 50 as it travels through the water. This results in a relatively small wetted surface which in turn results in a much faster boat. At the same time the boat is stable without the need for including daggerboards and the like which are difficult to handle, which tend to slow the speed of the boat and which limit launching and beaching.

The hull 50 is also capable of a variety of uses and can be easily stored and transported. Cross members 72 are easily removable and hulls 50 reattached to provide a compact fishing boat or lifeboat as illustrated in FIG. 9. At the same time, the hulls 50 while so attached are easy to transport on a car top, rack or may even be lifted onto and secured to the water ski platform on the back of a conventional motor boat.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A boat hull having front and rear portions and a pair of side walls comprising:

an upper section forming an upper portion of said hull; and an underside attached to said upper section and forming the lower portion of said hull, said underside having a nose and a rear and including a pair of side walls, said side walls being configured so as to include one or more curved indentations disposed longitudinally along the entire length of said underside wherein said curved identations form substantially acute angles with respect to said side walls such that said indentations are capable of producing a hydrofoil effect such that said hulls ride upon a cushion of air or water mixed with air confined beneath said identations when said hull moves through the water, and an elongated keel which extends generally downwardly from said hull and which is disposed longitudinally on said underside wherein said elongated keel extends from the nose of said underside to a point sufficiently removed from the rear of said underside that a rudder may be attached to the rear of the said hull without interference with said keel.

2. A boat hull as defined in claim 1 wherein said underside comprises to curved indentations disposed longitudinally on said underside and both of which are capable of producing a hydrofoil effect when said hull is moving through the water.

3. A boat hull as defined in claim 2 wherein said keel is disposed between said curved indentations.

4. A boat hull as defined in claim 3 wherein the underside of said hull is symmetrical.

5. A boat hull as defined in claim 1 further comprising an ice chest cavity formed in the upper section of said hull.

6. A boat hull as defined in claim 1 wherein the interior of said hull is constructed of a foam material.

7. A boat hull as defined in claim 1 further comprising a pair of sleeves disposed transversely on the top of said upper portion.

8. A boat hull as defined in claim 1 further comprising a rudder attached to the rear of said hull and extending into the space created behind said keel.

9. A catamaran comprising:

a pair of hulls having front and rear portions, said hulls also having upper sections forming the upper portion of said hulls and an underside attached to said upper sections and forming the lower portion of said hulls, said underside having a nose and a rear and including a pair of side walls, said side walls being configured so as to include one or more curved indentations disposed longitudinally along the entire length of said underside wherein said curved indentations form substantially acute angles with respect to said side walls such that said indentations are capable of producing a hydrofoil effect such that said hull rides upon a cushion of air or water mixed with air confined beneath said indentations when said hull moves through the water, and an elongated keel which extends generally downwardly and which is disposed longitudinally on said underside;

means for securely connecting said hulls to one another to form said catamaran;

means for carrying passengers and cargo on said catamaran; and means for steering said cataraman.

10. A catamaran as defined in claim 9 wherein the said underside of said hulls comprises two curved indentations disposed longitudinally on said underside and both of which are capable of producing a hydrofoil effect when said hull is moving through the water.

11. A catamaran as defined in claim 10 wherein said keel is disposed between said curved indentations..

12. A catamaran as defined in claim 11 wherein the underside of said hulls are symmetrical.

13. A catamaran as defined in claim 9 further comprising an ice chest formed in the upper section of at least one of said hulls.

14. A catamaran as defined in claim 9 wherein the interior of said hulls are constructed of a foam material.

15. A catamaran as defined in claim 9 further comprising a pair of sleeves disposed transversely on the top of said upper portion of said hulls.

16. A catamaran as defined in claim 9 wherein said elongated keels extend from the nose of the underside of said hulls to a point sufficiently removed from the rear of said underside of said hulls that a rudder may be attached to the rear of said hulls without interference with said keel.

17. A catamaran as defined in claim 16 further comprising a rudder mechanism attached to the rear of said catamaran and extending into the space created behind said keels.

18. A catamaran as defined in claim 16 wherein said means for securely connecting said hulls comprises cross members removably secured within said sleeves of one hull and extending to and being secured within corresponding sleeves of the other hull.

19. A catamaran as defined in claim 9 wherein said means for carrying passengers and cargo comprises a plurality of seats securely attached to the upper section of said hulls.

20. A catamaran as defined in claim 19 wherein said means for carrying passengers and cargo comprises a trampoline securely attached to said cross members.

21. A catamaran as defined in claim 20 wherein said trampoline is securely attached to said hulls.

22. A catamaran as defined in claim 21 wherein said trampoline is removably attached to said hulls by a plurality of straps.

23. A boat hull comprising:

an upper section forming the upper portion of said hull having an opening therein suitable for use as an ice chest and a pair of sleeves disposed transversely on the top of said upper section; and an underside attached to said upper section and forming the lower portion of said hull, said underside including a pair of side walls, said side walls being configured so as to have a pair of semi-circular indentations disposed longitudinally along the entire length of said underside wherein said semi-circular indentations form substantially acute angles with respect to said side walls such that said indentations are capable of producing a hydrofoil effect such that said hull rides upon a cushion of air or water mixed with air confined beneath said indentations when said hull moves through the water, and an elongated keel molded into said underside and extending longitudinally along said underside between said indentations.

24. A method of providing a fishing boat comprising: providing a pair of hulls, each said hull comprising an upper section forming an upper portion of said hull and an underside attached to said upper section and forming the lower portion of said hull, said underside including a pair of side walls, said side walls, being configured so as to include one or more curved indentations disposed longitudinally along the entire length of said underside wherein said curved indentations form substantially acute angles with respect to said side walls such that said indentations are capable of producing hydrofoil effect such that said hull rides upon a cushion of air or water mixed with air confined beneath said indentations when said hull moves through the water, and an elongated keel which extends generally downwardly from said hull and which is disposed longitudinally on said underside, each said hull having at least two sleeves disposed transversely on and attached to the top of the upper portion of said hull; and attaching the sleeves of one hull to the corresponding sleeves of the other hull.

25. A method of providing a fishing boat as defined in claim 24 further comprising one or more seats attached to the upper portion of said hulls.

26. A method of providing a fishing boat as defined in claim 25 wherein said hulls further comprise a means for steering said hulls.

27. A method of providing a fishing boat as defined in claim 26 wherein said means for steering said hulls comprises a rudder.

* * * * *